United States Patent [19]

Lockhart

[11] 4,159,129

[45] Jun. 26, 1979

[54] PHARMACEUTICAL RECORD AND LABEL SYSTEM

[76] Inventor: James L. Lockhart, 6922 S. Jeffery, Chicago, Ill. 60649

[21] Appl. No.: 831,818

[22] Filed: Sep. 9, 1977

[51] Int. Cl.[2] ..... B41L 1/24; G09F 7/12

[52] U.S. Cl. ..... 282/27 R; 282/28 R; 40/158 R

[58] Field of Search ..... 282/27 R, 27 A, 28 R; 40/158 R

[56] References Cited

U.S. PATENT DOCUMENTS

| | | | |
|---|---|---|---|
| 1,330,726 | 2/1920 | Small | 282/27 A |
| 1,757,598 | 5/1930 | Smith | 282/27 R |
| 3,740,879 | 6/1973 | Patterson | 40/158 R X |
| 4,021,060 | 5/1977 | Seeley et al. | 282/28 R |
| 4,029,341 | 6/1977 | Neill et al. | 282/28 R X |

*Primary Examiner*—Willie G. Abercrombie

*Attorney, Agent, or Firm*—Hill, Gross, Simpson, Van Santen, Steadman, Chiara & Simpson

[57] ABSTRACT

In an illustrated embodiment, a backing sheet capable of storing information relative to pharmaceutical prescriptions has a first series of adhesively backed pharmaceutical prescription label segments removably secured thereto, each label segment having formatted zones thereon for facilitating entry of typed information and accommodating simultaneous transfer of typewriter impressions to the backing sheet. A second series of supplemental data segments on the backing sheet provide for recording of supplementary information with respect to each label segment contemporaneously with the typing of the label segment. After removal of a prescription label segment from the backing sheet, the backing sheet has stored thereon both the formatted information as entered on the label segment and necessary supplemental data so as to facilitate computerized pharmaceutical accounting.

2 Claims, 5 Drawing Figures

PHARMACEUTICAL RECORD AND LABEL SYSTEM

CROSS REFERENCE TO RELATED APPLICATION

Reference is hereby made to a continuation in part application Ser. No. 007,217, filed Jan. 29, 1979, continuing the disclosure of the present application and seeking generic coverage for certain improved embodiments based on the present disclosure.

BACKGROUND OF THE INVENTION

In the field of pharmaceutical accounting, a number of the States have established a specialized format for accounting of prescriptions filled for public aid recipients. For example, the State of Illinois Department Of Public Aid has established a new invoice form DPA 215 (R-6-76) which presents a substantial problem to small pharmacies seeking to be of service in this field. The filling out of such forms by means of a manually operated typewriter requires such a high degree of skill and accuracy as to present a serious obstacle to the individual pharmacy.

SUMMARY OF THE INVENTION

It is a particular object of the present invention to provide a record and label system for computerized pharmaceutical accounting which is sufficiently adaptable to enable its practical use by individual pharmacies as an integral part of the process of filling prescriptions.

A particular feature of the system resides in the provision of a record and label system wherein the act of preparing a formatted prescription label simultaneously provides hard copy data necessary to computerized accounting, a backing sheet which accumulates the label information having supplemental data segments for recording of supplementary information with respect to each label adjacent the space on the backing sheet storing character impressions with reference to the label segment, whereby after entry of information on the prescription label segments and removal thereof from the backing sheet, the backing sheet has stored thereon at each of a succession of unified identifiable regions of the backing sheet both formatted information as entered on the label segment and necessary supplemental data pertaining to a given prescription. The resultant backing sheet then contains a hard copy of the data required for computerization of the accounting process and being in a form suitable for delivery to a central computing station or the like under the varied circumstances of individual pharmacies. The system has actually been put into practice with a number of individual pharmacies and has successfully enabled the submission of the complex forms to the State within remarkably short time intervals after completion of the transactions in question.

Other objects, features and advantages of the present invention will be apparent from the following detailed description taken in connection with the accompanying sheets of drawings.

DETAILED DESCRIPTION OF A PREFERRED EMBODIMENT

Figure 1:
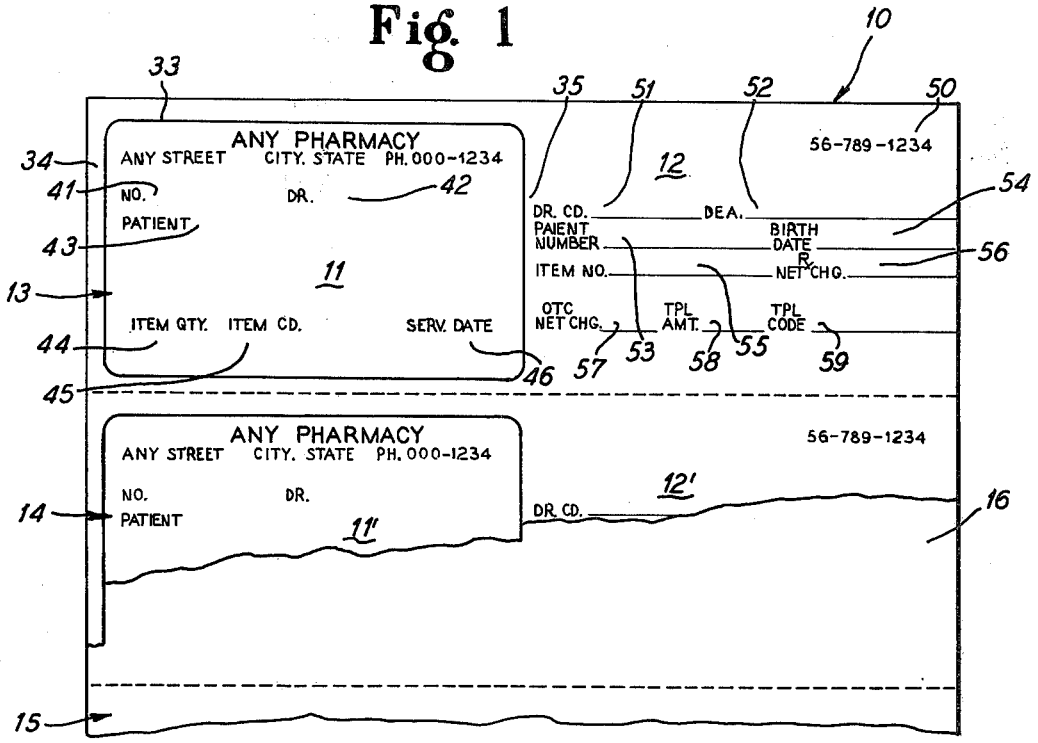
FIG. 1 illustrates a partial plan view of a record and label assembly in accordance with the present invention prior to entry of information with respect to individual pharmaceutical prescriptions.
Figure 2:
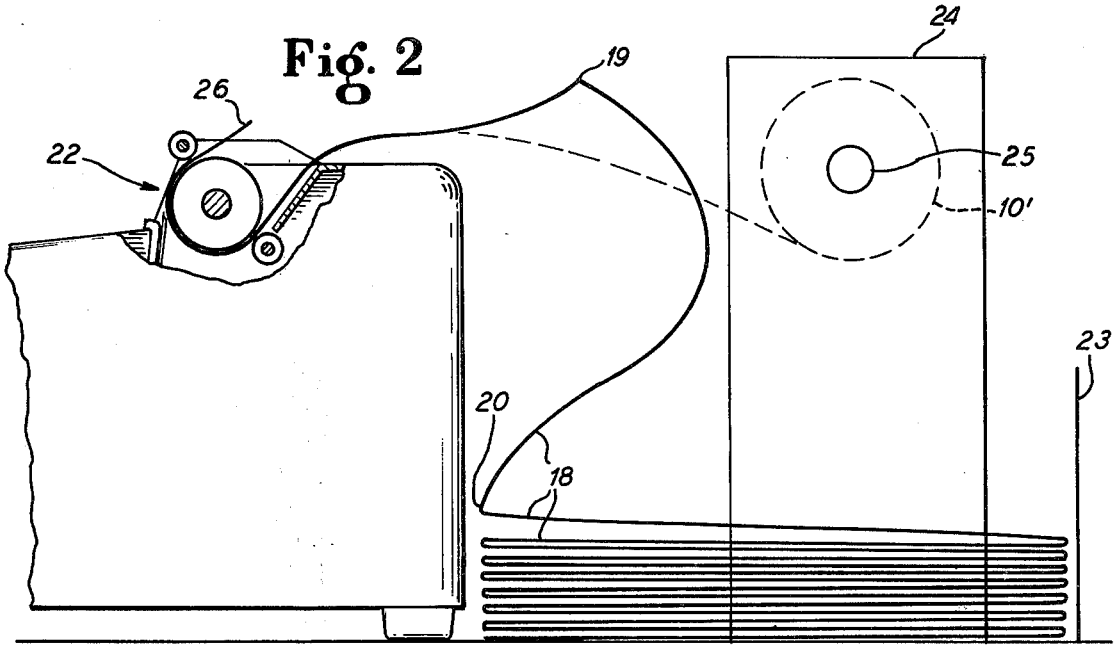
FIG. 2 is a somewhat diagrammatic partial elevational view illustrating the record and label assembly of FIG. 1 being fed into a manually operated typewriter for entry of data with respect to individual pharmaceutical prescriptions.

In the illustrated embodiment, a record and label assembly 10 includes a pharmaceutical prescription label segment such as 11 and a supplemental data segment such as 12 at each of a series of unified data locations such as 13, FIG. 1, on a backing sheet 16. By way of preferred example, a convenient number of data locations such as three locations 13, 14 and 15 may be disposed on respective normally flat data sections such as indicated at 18 in FIG. 2, the successive sections 18 being joined together at successive pre-creased fold lines such as indicated at 19 and 20, so that the assembly 10 is adapted to lie flat in an accordion fold relation for handling and shipping. Prior to the development of this flat folded construction of the record and label assembly, the assembly was handled in the form of a roll as diagrammatically indicated at 10'. A typewriter such as indicated at 22 may suitably be provided with a bin configuration 23 for retaining the folded assembly 10 and also be provided with a reel type mounting including a side support 24 and a spindle 25 for mounting a roll configuration such as 10'. Thus, with the provision of means such as indicated at 23–25, typewriter 22 can receive either the preferred flat folding assembly 10 or the roll assembly 10' where it might be desired to accommodate both forms of record assembly. The assembly 10 at its leading edge 26 may be led back over the spindle 25 when the flat folded form is utilized so as to provide clearance between the incoming data sections and the data sections which have already received typed data with respect to individual pharmaceutical prescriptions.

Figure 3:
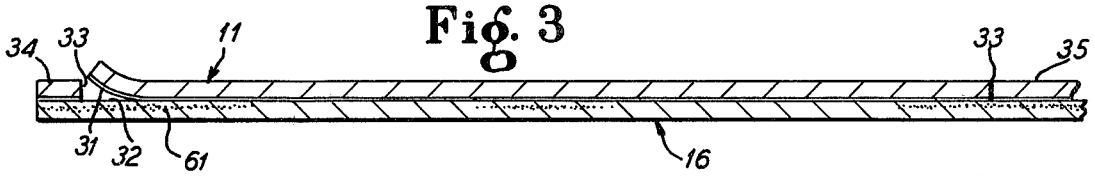
FIG. 3 is a somewhat diagrammatic transverse sectional view of the assembly of FIG. 1 and illustrating the step of removing a pharmaceutical prescription label segment from the backing sheet of the assembly after typed entry of the data with respect to such prescription.
Figure 4:
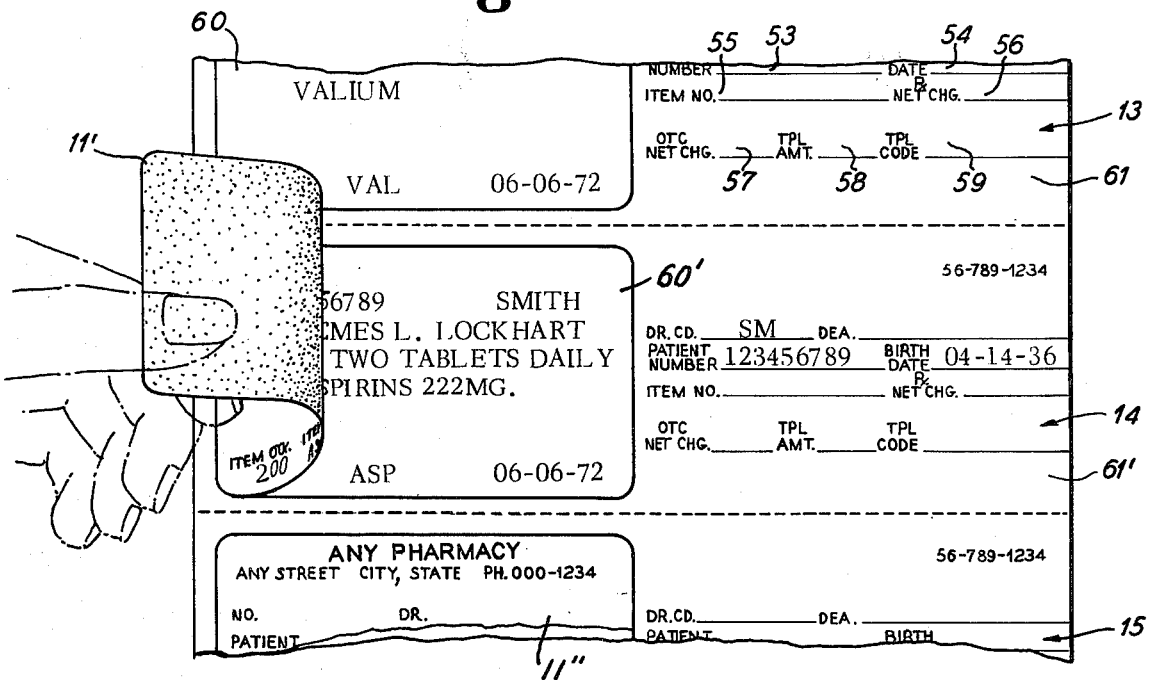
FIG. 4 is a somewhat diagrammatic partial plan view similar to FIG. 1 but illustrating a backing sheet of the assembly of FIGS. 1–3 after entry of data with respect to at least two successive pharamaceutical prescriptions, the figure showing a prescription label segment in the process of being removed from the backing sheet with respect to a central area of FIG. 4.

In the illustrated embodiment, each of the label segments such as 11 and 11' in FIG. 1 and such as indicated at 11' and 11'' in FIG. 4 is provided with a permanent adhesive backing such as indicated at 31 in FIG. 3, such backing being readily stripped from an interface surface 32 of backing sheet 16. Each of the label segments such as 11 and 11' in FIG. 1 is separate and severable from the assembly 10 by virtue of a pre-formed severance gap such as indicated at 33 which laterally separates each label segment from adjoining portions such as 34 and 35, FIG. 3, of the assembly 10. In a relatively high quality assembly 10, portions 34 and 35 are of the same material as the label segments such as 11 and have the same interface relation to the backing sheet 16 so that the assembly 10 as supplied to the individual pharmacy is of uniform thickness over its width and has a high quality typing surface which readily receives and retains typewritten data applied thereto by means of the manual typewriter 22.

As supplied to the individual pharmacy, the assembly 10 has a printed format thereon as shown in FIG. 1 providing for the typewritten entry of data at data regions 41–46 as follows: region 41, a prescription number which may be an eight digit decimal number; region 42, the name of the medical doctor issuing the prescription; region 43, the name of the patient; region 44, the quantity of the medication prescribed, with provision, for example, for a three digit decimal number; region 45, an item code which may be any desired set of typed characters for identifying a given medication in the inventory of the individual pharmacy; region 46 providing for the entry of the service date. The item code can have provision for a four character code, each desired item having an established eight decimal digit item number which is required for the drug invoice form such as Illinois form DPA 215 (R-6-76) previously referred to.

By providing specifically arranged regions 41–46, and by providing an individual item code for the given pharmacy, a conventional size of label such as 11 can be utilized to simultaneously provide a maximum amount of information for the drug invoice without unduly burdening the individual pharmacy.

In the illustrated embodiment, the assembly 10 comprises a second series of supplemental data segments on the backing sheet 16 such as those indicated at 12 and 12', each supplemental data segment being laterally adjacent one of the label segments such as 11 and 11'. As illustrated, each assembly 10 is provided with a suitable code such as indicated at 50 which uniquely identifies the particular pharmacy for which such assembly is prepared. The code at region 50 thus enables the interpretation of the item code given at region 45 of the label segment so as to uniquely identify each eight digit item number as it must be presented on the drug invoice for purposes of pharmaceutical accounting. Each supplemental data segment such as that at 12 is further provided with formatted regions as indicated at 51–59, the regions 51 and 52 being in exact alignment with regions 41 and 42 of the associated label segment so as to be typed all on a common line by means of a typewritter such as indicated at 22. Similarly, regions 53 and 54 are on a common line with region 43 of the associated label segment, regions 51, 52; 53, 54; and 55, 56 having a spacing equal to the conventional line spacing of manual typewriters such as 22, so that once the typewriter is properly aligned with a given region such as 41, the automatic indexing of the typewriter will provide for proper entry of data at successive regions such as 51–59 as well as regions such as 42–46 of the label segment.

The significance of the regions 51–59 in the illustrated embodiment is as follows: region 51, a doctor identification code specific to the individual pharmacy, and keyed to an official nine character identification for prescribing practitioner; region 52, a space for the nine character official identification of prescribing practitioner, should a code for such practitioner not be established for the particular pharmacy represented by the identification at region 50, region 52 in conjunction with region 51 thus providing for the automatic entry of new practitioners into the list for the particular individual pharmacy; region 53 provides space for the official nine digit recipient identification number required by the drug invoice; region 54 providing further identification of the patient in the form of the data of birth of the patient; region 55 providing for entry of the official eight digit item number should no item code have been established with reference to region 45 of the associated label segment; region 56 providing space for entry of the net charge for the prescription; region 57 providing for entry of net charge in the case of an over-the-counter item; region 58 and region 59 refer to third party liability amount, and code identifying a copayer.

The item code in region 45 may be keyed to the current unit retail price of the medication so that this information along with item quantity can be used to automatically compute the net charge on the DPA 215 invoice.

As indicated at data field 60 in FIG. 4, at the time that a label such as 11 is typed, the imprinted characters are simultaneously transferred to the backing sheet 16 by virtue of the structure of the backing sheet 16 beneath label segments such as 11, the labels being sufficiently thin and pliable to accommodate such transfer. For example, backing sheet 16 particularly at the surface thereof underlying label segments such as 11 may be provided with encapsulated ink particles as indicated at 61 in FIG. 3 whereby ink particles are freed and become visible in the pattern of character impressions applied by typewriter 22 to the label segment such as 11. Thus the typewritten characters are transferred to the region 60 of backing sheet 16 simultaneously with the typewritten entry of the data on the label segments such as 11. After removal of the label segments such as 11, the backing sheet has stored thereon at a unified identifiable data location such as 13, 14 or 15 in FIG. 4 both formatted information as entered on the label segment and necessary supplementary data pertaining to a given prescription as entered at regions 51–59, FIG. 1, a supplementary data field 61 including regions 55–59 appearing in FIG. 4 together with associated data relevant to the prescription of data field 60.

Figure 5:
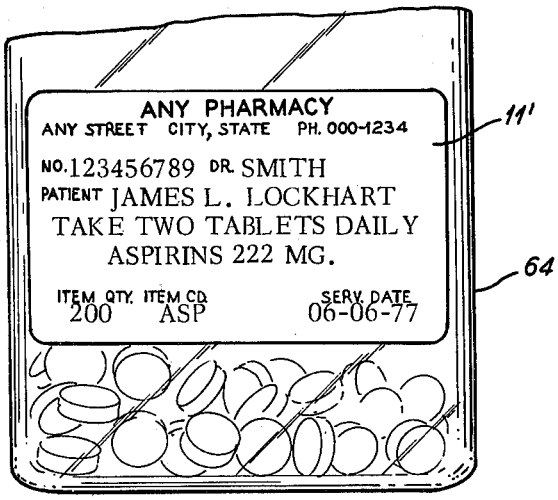
FIG. 5 is a partial diagrammatic view illustrating the application of the label segment removed in FIG. 4 to a container for the medication specified by the subject prescription.

FIG. 4 also shows label segment 11' being removed from the backing sheet 16 to leave the corresponding data field 60' with its associated supplementary data field 61' forming the further unified data location 14. FIG. 5 shows the label 11' of FIG. 4 applied to a container 64 which is to contain the medication of subject prescription. Thus the necessary data for computerization is generated simultaneously with the production of the identifying label for the container 64 with a minimum of further effort and expenditure of time. Further, because all of the necessary data for the drug invoice is accumulated at one time and simultaneously with the generation of the prescription label, the chances of error are minimized. By pre-storing the required eight digit item numbers and nine character prescribing practitioner identifications with respect to each individual pharmacy (as identified at 50 in FIG. 1), a computer system can accurately enter these numbers on the required drug invoice form with greatly reduced chances of error. For example, the doctor code entered on each prescription label segment may take the form of the doctor's initials in many cases, greatly simplifying and speeding the work at the individual pharmacy, while vastly reducing the overall chance of error. The item codes for the individual pharmacies may utilize mnemonic devices of a similar nature to speed entry of the base data and minimize the possibility of errors.

In a minimum record assembly, the backing sheet 16 may itself provide the supplementary data segments which directly receive the typewriter impressions. Where the backing sheet is of relatively thin low cost construction, the roll configuration 10' would be the usual form for storage and transport.

It will be apparent that many modifications and variations may be effected without departing from the scope of the novel concepts and teachings of the present invention.

I claim as my invention:

1. In a record and label system for computerized pharamaceutical accounting wherein both label information and non-label information are required for the preparation of a pre-established pharmaceutical invoice by each of a multiplicity of pharamaceutical dispensing entities, said non-label information comprising a unique relatively lengthy multidigit doctor identification number and a unique relatively lengthy multidigit item identification number each of which being unique for individual doctors and individual pharmaceutical items, respectively, at the invoice-receiving agency, said record and label system comprising:

a backing sheet capable of storing information relative to pharmaceutical presciptions transferred thereto as character impressions, in a readable form, a first series of adhesively backed pharamaceutical prescription label segments adhesively secured to portions of said backing sheet with an interface therebetween permitting manual stripping of the label segments with adhesive backing in tact from said backing sheet, said label segments each having a front surface with formatted zones thereon for facilitating entry of typed information onto such front surface while accommodating simultaneous transfer of the imprinted characters to said backing sheet, and a second series of supplemental data segments on the backing sheet to provide for recording of supplementary information with respect to each label segment at a location on the backing sheet adjacent the space on the backing sheet storing character impressions with reference to the label segment, the backing sheet after entry of information on the prescription label segments and removal of the label segments, having a succession of unified identifiable regions each such region having both formatted information as entered on a label segment and necessary supplementary data pertaining to a given prescription and necessary to the preparation of said pharmaceutical invoice, each said unified identifiable region of the backing sheet comprising individual selective entry records including a relatively abbreviated individual item code and a relatively abbreviated individual doctor code, each having a meaning for a given individual pharmaceutical dispensing unit which has prepared such individual selective entry records on a given backing sheet, and pharmaceutical dispensing unit identifying means directly associated with each backing sheet for providing a unique identification of the individual pharmaceutical dispensing unit which has prepared the individual selective entry records on such backing sheet, whereby the pharmaceutical invoices for any of a multiplicity of pharmaceutical dispensing units may be prepared at a central data processing station, utilizing the relatively abbreviated individual item codes and the relatively abbreviated individual doctor codes in conjunction with the unique pharmaceutical dispensing unit identifying means directly associated therewith.

2. A record and label system for computerized pharmaceutical accounting, comprising a backing sheet capable of storing information relative to pharmaceutical prescriptions transferred thereto as character impressions, in a readable form, a front preprinted sheet secured to said backing sheet and providing a first series of adhesively backed pharmaceutical prescription label segments adhesively secured to portions of said backing sheet with an interface therebetween permitting manual stripping of the label segments with adhesive backing in tact from said backing sheet, said label segments each having a front surface with preprinted formatted zones thereon for facilitating entry of typed information onto such front surface while accommodating simultaneous transfer of the imprinted characters to said backing sheet, and said front preprinted sheet having a second series of supplemental data segments preprinted thereon to provide for recording of supplementary information with respect to each label segment at a location adjacent the space on the backing sheet storing character impressions with reference to the label segment, whereby after entry of information on the prescription label segments and removal thereof from the backing sheet, the backing sheet has stored thereon at each of a succession of unified identifiable regions of the backing sheet the formatted information as entered on a label segment, and the front preprinted sheet secured to said backing sheet has the necessary supplementary data pertaining to a given prescription.

* * * * *